US006386798B2

(12) United States Patent
Finn

(10) Patent No.: US 6,386,798 B2
(45) Date of Patent: May 14, 2002

(54) UNIVERSAL CATENARY RISER SUPPORT

(75) Inventor: Lyle David Finn, Sugar Land, TX (US)

(73) Assignee: Deep Oil Technology Incorporated, Houston, TX (US)

( * ) Notice: Subject to any disclaimer, the term of this patent is extended or adjusted under 35 U.S.C. 154(b) by 0 days.

(21) Appl. No.: 09/281,453

(22) Filed: Mar. 30, 1999

(51) Int. Cl.[7] ..... E02B 17/01
(52) U.S. Cl. ..... 405/224.2; 166/359; 166/367
(58) Field of Search ..... 166/367, 359, 166/351, 345, 341, 342; 405/224.1, 4.2, 4.3, 4.4, 223.1, 167, 168.1, 168.2, 168.3, 168.4, 170, 172, 173, 169, 195.1

(56) References Cited

U.S. PATENT DOCUMENTS 3,605,415 A * 9/1971 Mohlman ..... 405/167
4,808,034 A * 2/1989 Birch ..... 405/195
5,437,518 A * 8/1995 Maloberti et al. ..... 405/169
5,639,187 A * 6/1997 Mungall et al. ..... 405/195.1
5,702,205 A * 12/1997 Mahone et al. ..... 405/169
5,722,492 A 3/1998 Finn
5,865,566 A 2/1999 Finn
5,873,677 A 2/1999 Davies et al.
5,887,659 A * 3/1999 Watkins ..... 166/350
5,947,642 A * 9/1999 Teixeira et al. ..... 405/195.1
6,003,873 A * 12/1999 Solberg ..... 405/169

* cited by examiner

*Primary Examiner*—Robert E. Pezzuto
*Assistant Examiner*—Raymond W Addie
(74) *Attorney, Agent, or Firm*—D. Neil LaHaye; Robert C. Baraona; Eric Marich

(57) ABSTRACT

A universal catenary riser support that can be designed to accommodate all riser pipe diameters typically considered for production of offshore hydrocarbons and allows the catenary riser to exit from the vessel at any azimuth angle and at a wide range of angles from the vertical. The support structure at the keel of the offshore structure is provided with a receptacle to receive a curved riser segment. The curved riser segment is adapted to be received in the receptacle. The curved riser is also adapted to receive a vertical riser section through the offshore structure. Relative motions between the catenary riser and the offshore structure are accommodated by a tapered section of riser or flexible joint attached to the curved riser section. A removable plug may be provided in the curved riser section to prevent water from entering the catenary riser during installation in the offshore structure.

8 Claims, 5 Drawing Sheets

UNIVERSAL CATENARY RISER SUPPORT

BACKGROUND OF THE INVENTION

1. Field of the Invention

The invention is generally related to the production of hydrocarbons from subsea formations and more particularly to the support of riser pipe used in such production.

2. General Background

In the offshore drilling and production industry, a pipe is often used to carry product (oil or natural gas) from the offshore production site to a collection and storage facility which may be a tanker or an on shore facility. For offshore structures that rest on the sea floor, such as a jacket or compliant tower, the flexing effect of environmental conditions such as waves and currents have a minimal effect on the design considerations when connecting the pipe to the offshore structure. However, for floating offshore structures the design of the interface between the pipe and offshore structure must take into account the bending motions, and resulting fatigue and stresses, that the pipe and interface must endure during the life of the structure. The steel catenary pipeline riser approach is generally considered as the most cost-effective means for transporting products to and from floating offshore production vessels.

For a floating structure such as a TLP (tension leg platform) or a semi-submersible, the typical configuration of this riser is for the pipe to be suspended from the side of the floating vessel from a support platform that is located just below the water surface (fifty to one hundred feet).

For a floating structure such as a spar vessel, the pipe for the riser may enter the interior are of the spar vessel at the keel or along the side of the spar vessel at a selected depth.

A disadvantage of previous catenary riser support configurations for floating structures is that the configuration normally has been limited to a certain riser diameter and narrow range of departure angles from the floating structure.

SUMMARY OF THE INVENTION

The invention addresses the above disadvantage. What is provided is a universal catenary riser support that can be designed to accommodate all riser pipe diameters typically considered for production of offshore hydrocarbons and allows the catenary riser to exit from the vessel at any azimuth angle and at a wide range of angles from the vertical. The support structure at the keel of the offshore structure is provided with a receptacle to receive a curved riser segment. The curved riser segment is adapted to be received in the receptacle. The curved riser is also adapted to receive a vertical riser section through the offshore structure. Relative motions between the catenary riser and the offshore structure are accommodated by a tapered section of riser or flexible joint attached to the curved riser section. A removable plug may be provided in the curved riser section to prevent water from entering the catenary riser during installation in the offshore structure.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
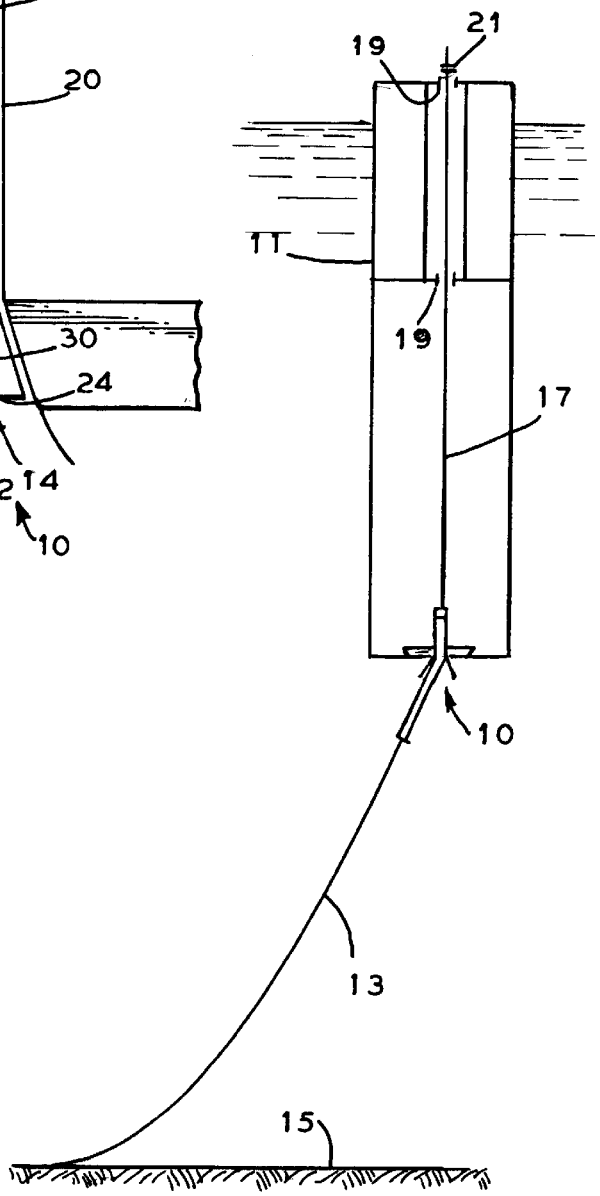
FIG. 1 is a side sectional view that illustrates the invention installed in a spar type vessel.

Referring to the drawings, it is seen in FIG. 1 that the invention is generally indicated by the numeral 10. Catenary riser support 10 is illustrated installed in a spar type vessel 11 such as that disclosed in U.S. Pat. No. 4,702,321. It should be understood that the invention is not limited to use with spar type vessels and may be used with any floating offshore structure. A typical situation is illustrated where a catenary riser 13 extends up from the sea floor 15 to the spar type vessel 11. The spar vessel 11 illustrated encloses the vertical riser segment 17 that runs through the vessel. Therefore, minimal guides 19 are required to provide lateral support to vertical riser segment 17. A top vertical support 21 is provided for the vertical riser segment 17 at the upper end of the vessel 11.

Figure 2:
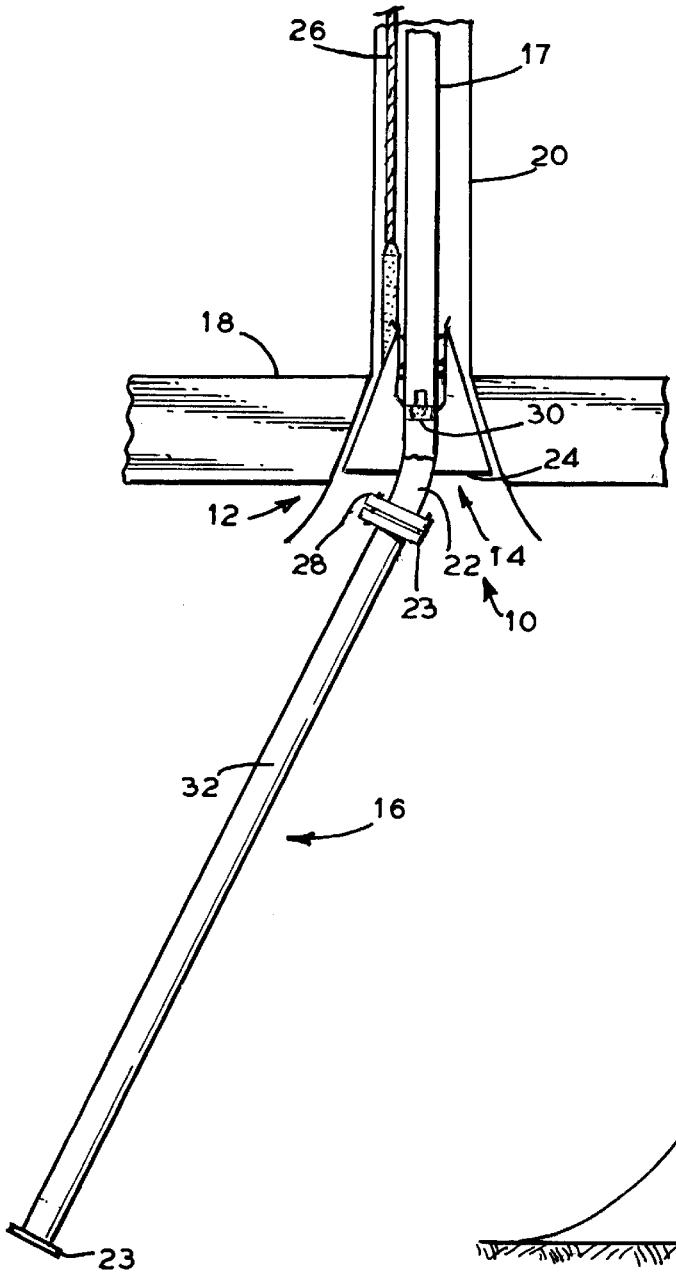
FIG. 2 is an enlarged detailed view of the preferred embodiment of the invention.

As best seen in FIG. 2, the catenary riser support 10 is generally comprised of receptacle 12, curved riser segment 14, and means 16 for accommodating relative motion between the offshore structure 11 and the catenary riser 13.

Receptacle 12 is received in the support structure 18 in the keel of the spar vessel 11. The receptacle 12 preferably is axially symmetric and cone shaped. The cone shape allows it to serve as a guide during installation of the curved riser segment 14. The receptacle 12 is provided with a diameter that is large enough to accept all reasonable sizes of catenary riser pipe.

As an option, a protective sleeve 20 may be provided to the receptacle 12 to give additional protection to the vertical riser segment 17. The sleeve 20 may be attached to the receptacle 12 as shown or to the support structure 18.

The curved riser segment 14 is formed from a pipe 22 and a fitting 24 attached to the pipe 22. The pipe 22 preferably has a radius of curvature on the order of five to ten pipe diameters for the purpose of allowing the passage of pipeline pigs there through. The fitting 24 is provided with a shape that is complementary to the receptacle 12 such that the fitting is readily received in the receptacle 12. Means for lifting the curved riser segment 14 into the receptacle 12 is provided in the form of a cable 26 attached to the fitting 24 and that is used as a pull-in line. A cable is merely an example of a suitable pull-in line and it should be understood that any suitable means such as a chain may also be used. Curved riser segment 14 is provided with a flange 28 at its lower end. This allows for attachment to a corresponding flange 23 on means 16 for accommodating the relative motion between the vessel 11 and catenary riser 13. Curved riser segment 14 may also be provided with an internal plug 30 that prevents entry of water into the catenary riser 13 during installation.

In the preferred embodiment, means 16 for accommodating the relative motion between the vessel 11 and catenary riser 13 is provided in the form of a tapered stress joint 32. The tapered stress joint 32 is provided with a flange 23 at each end for connection at the upper portion to the curved riser segment 14 and at the lower portion to the catenary riser 13. In the preferred embodiment, the tapered stress joint 32 is formed from a riser pipe that progressively tapers from a thicker wall diameter at the upper portion to a thinner wall diameter at the lower portion.

Figure 3:
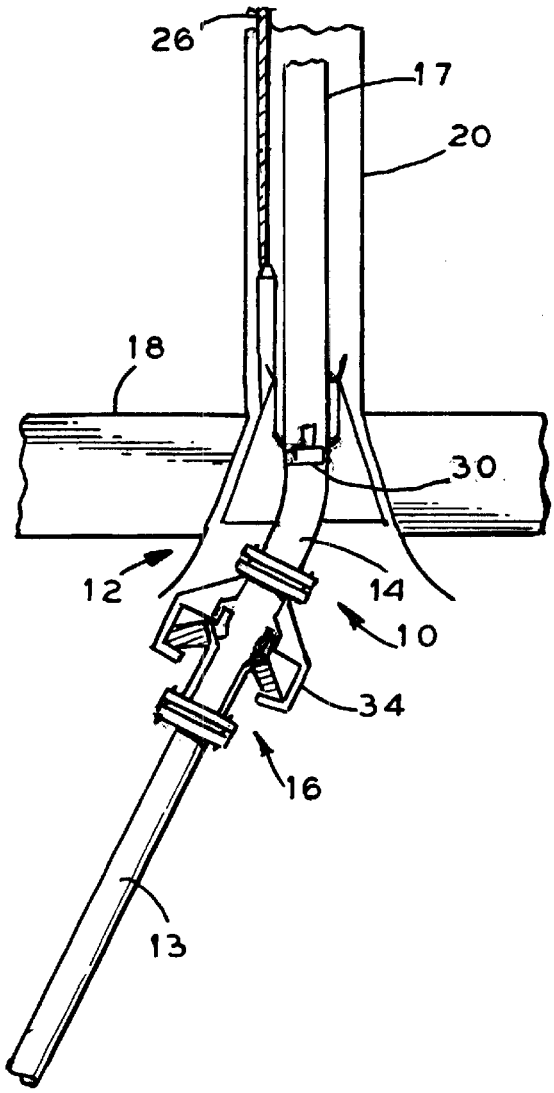
FIG. 3 illustrates an alternate embodiment of the means for accommodating relative motion between the catenary riser and floating offshore structure.

FIG. 3 illustrates an alternate embodiment of means 16 in the form of a flex joint 34 attached between the catenary riser 13 and the curved riser segment 14. Flex joints are generally known in the industry.

Figure 4:
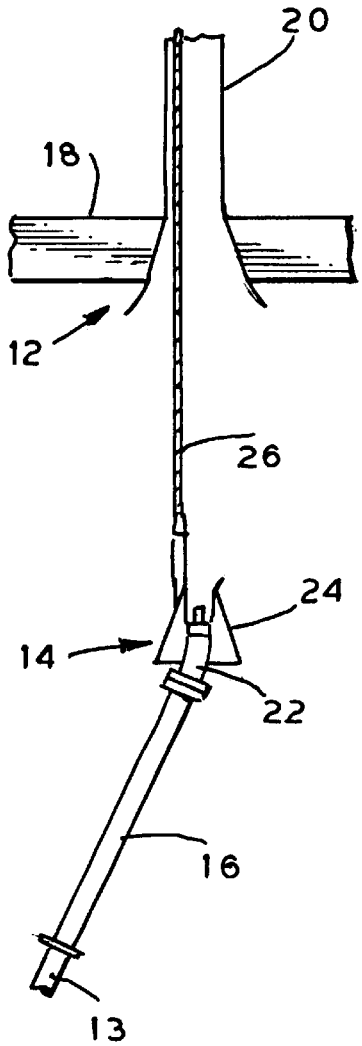
FIGS. 4–6 illustrate the installation of the invention in a floating offshore structure.
Figure 5:
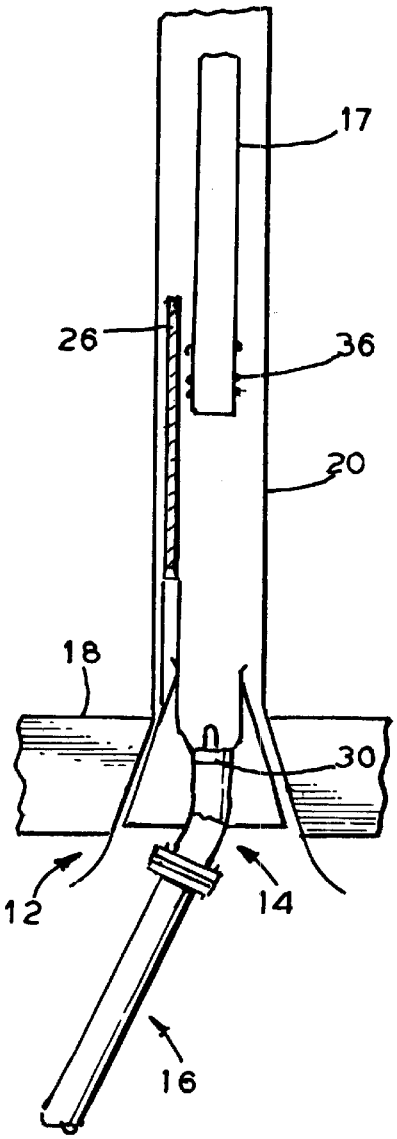
Figure 6:
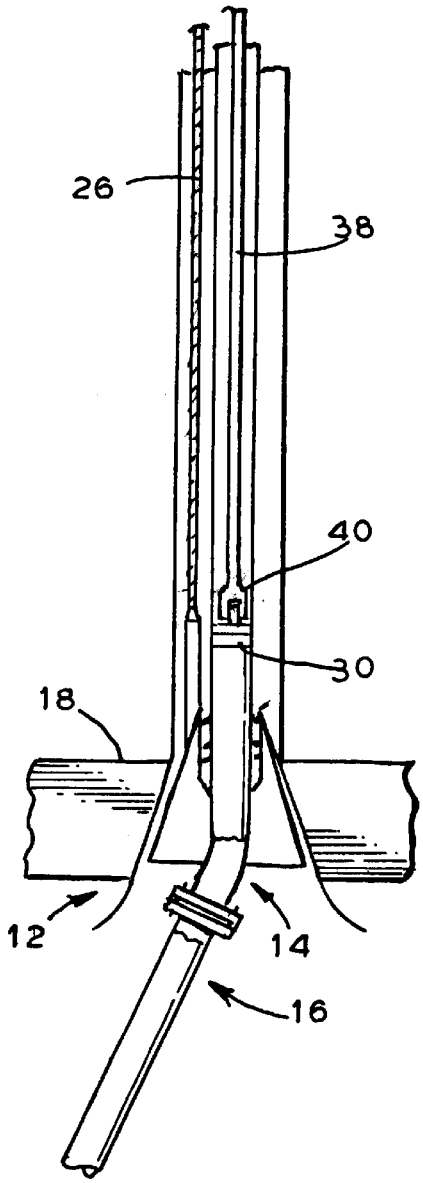

Installation is illustrated in FIGS. 4–6. The cable 26 is used to pull the curved riser segment 14 and accommodation means 16, already connected to catenary riser 13, up into the receptacle 12 in the support structure of the vessel 12 as seen in FIG. 4. Once the curved riser segment 14 is positioned in the receptacle, the vertical riser section 17 is lowered through the vessel as seen in FIG. 5. The vertical riser segment 17 is then attached to the curved riser segment 14 using a connector 36. Any suitable connector such as an internal tieback connector may be used. An external tieback connector may also be used if desired. However, the use of an external connector will require that the lateral support guides in the vessel be of a larger diameter than required for the internal connector in order to allow passage of the external connector. Once the vertical riser segment 17 is connected to the curved riser segment 14 and supported vertically by top vertical support 21, it can be used to support the catenary riser 13 and tension on the cable 26 may be released. As seen in FIG. 6, after connection of the two sections, the plug 30 is removed by the use of any suitable means. This would typically be accomplished by using a drill pipe 38 that is fitted with a tool 40 adapted to latch onto and release the plug 30 from the curved riser segment 14. The use of such tools for removing plugs is generally known in the industry. The riser is then ready for production of hydrocarbons.

Figure 7:
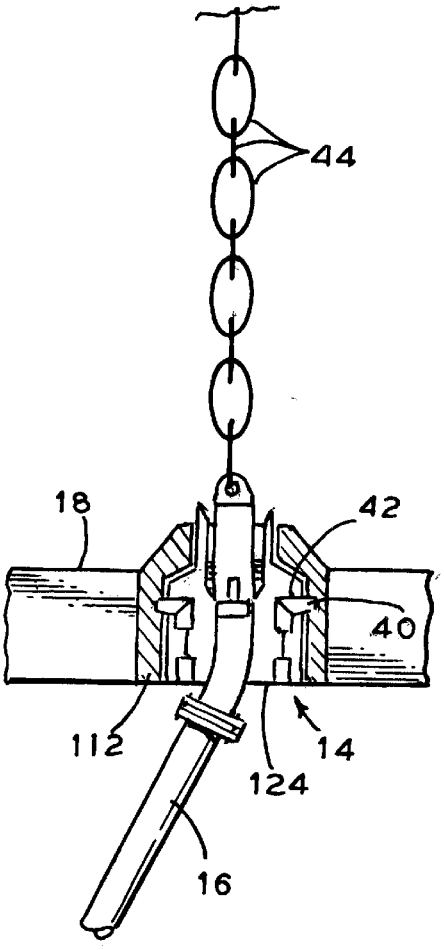
FIG. 7 illustrates an alternate embodiment of the invention.

FIG. 7 illustrates an alternate embodiment of the receptacle 12 (indicated by numeral 112) and fitting 24 (indicated by numeral 124). Receptacle 112 is provided with a groove 40 along the inner circumference. A series of latching dogs 42 are provided on fitting 124 and adapted to be received in groove 40. Once latched in place, fitting 124 supports the catenary riser 13 and allows the removal of the lifting chain 44 CASE 6037 before the vertical riser segment is lowered into place and connected to the curved riser segment 14. The use of circular grooves and corresponding latches is generally known in the industry.

Figure 8:
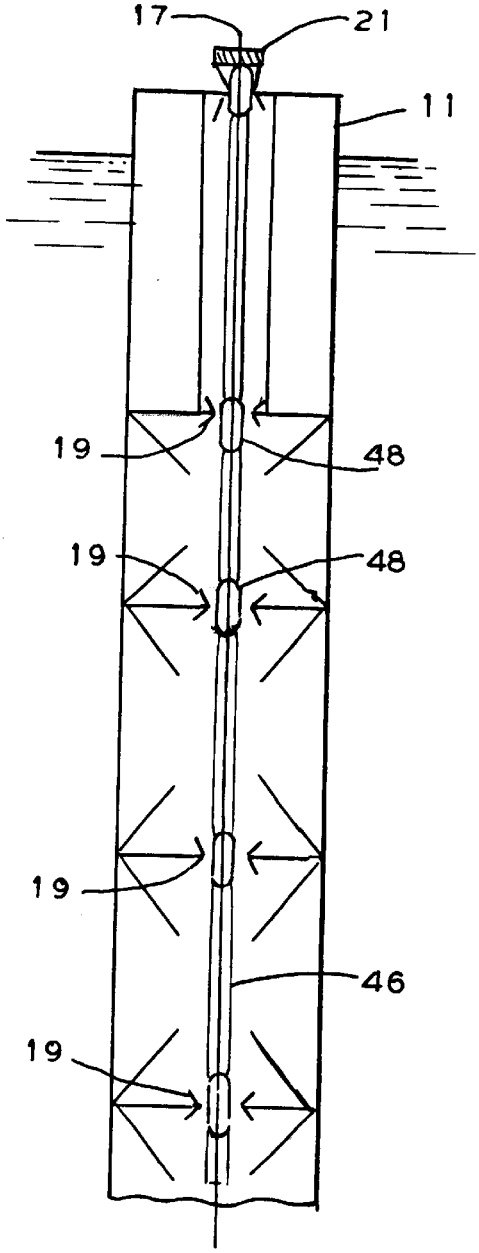
FIG. 8 illustrates spacer elements attached to the vertical riser segment in the floating offshore structure.

FIG. 8 illustrates the vertical riser segment 17 in a spar type vessel such as that described in U.S. Pat. No. 5,558,467 where the lower portion of the vessel forms an open truss structure. In this type of vessel, additional lateral guides 19 are provided along the length of the vessel to provide lateral support to the riser against wave and current forces. An insulation material 46 may be provided on the riser to keep the hydrocarbons warm and reduce the potential for the formation of waxes and hydrates that could significantly reduce the fluid flow or entirely plug the riser. Spacer elements 48 may also be provided along the length of the riser at the locations of the lateral supports 19.

Figure 9:
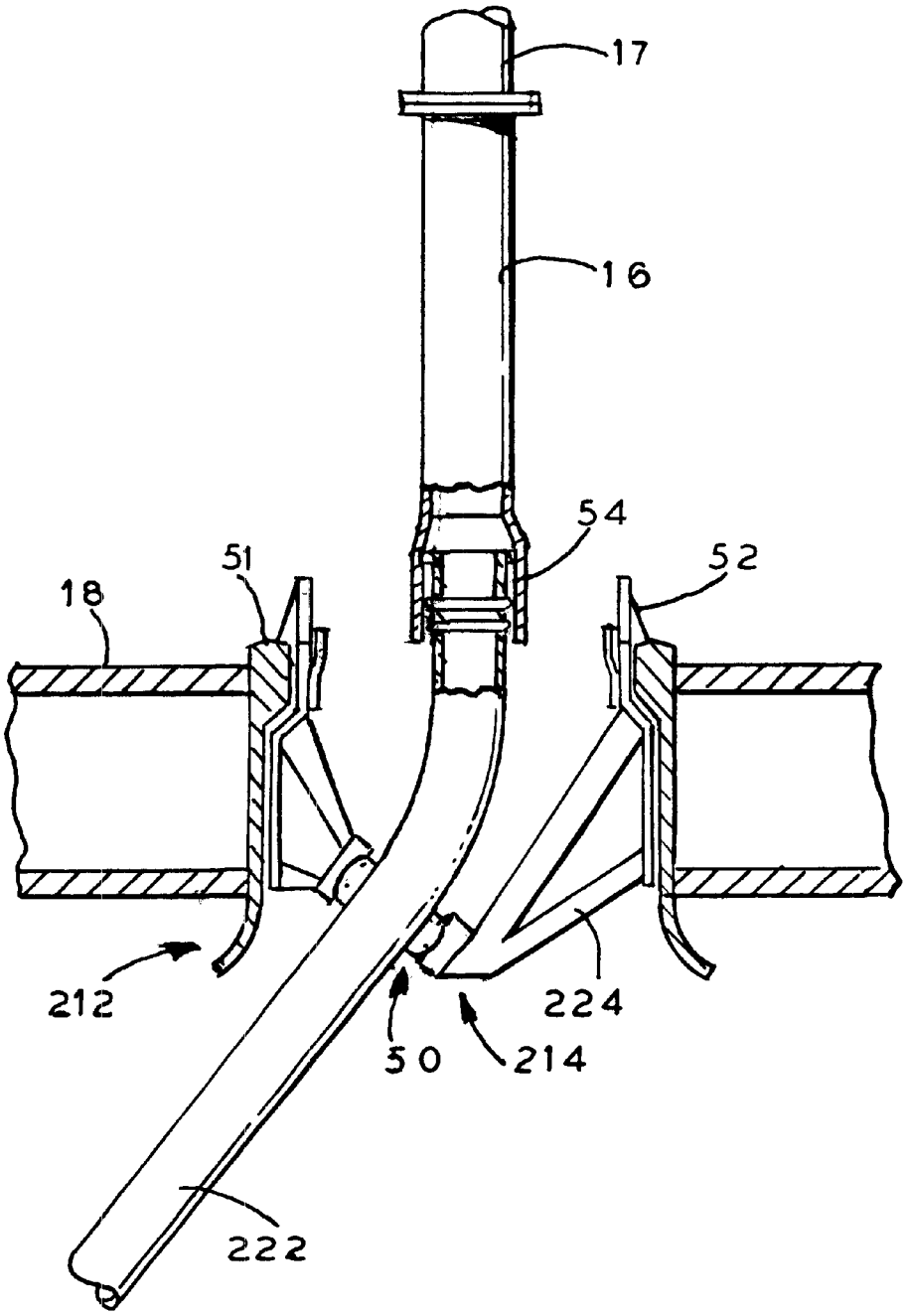
FIG. 9 illustrates an alternate embodiment of the means for accommodating relative motion between the catenary riser and floating offshore structure.

FIG. 9 illustrates another alternate embodiment of the receptacle 12 (indicated by numeral 212), curved riser segment 14 (indicated by numeral 214), and the means 16 for accommodating relative motion between the vessel 11 and the catenary riser 13. The curved riser segment 214 utilizes a flex joint 50 in the fitting 224 that receives the pipe 222. The receptacle 212 has an upper shoulder 51 adapted to receive latching dogs 52 on the fitting 224. The pipe 222 is formed from the catenary riser and is provided with a bend that matches the required angle. A radius of curvature on the order of five to ten pipe diameters is sufficient to allow for the passage of pipeline pigs.

In this design, the vertical riser segment 17 is fitted with means 16 for accommodating relative motion between the vessel 11 and pipe 222. Means 16 is a stress joint that is formed from a tapered section of riser pipe. With this design, the stress joint accommodates the relative angular motion between the vessel 11 and the pipe 222. An external tieback connector 54 is illustrated for connecting the motion accommodating means 16 to the pipe 222.

The advantage of placing the stress joint above the support mechanism instead of below as described in the preferred embodiment is that the axial load in the stress joint with the alternative design is much lower than in the preferred embodiment. This lower tension will result in lower bending stresses in the stress joint and thus a short, thinner, and less expensive tapered stress joint design. The disadvantage of this alternate design is that the vertical segment of the riser will move up and down slightly as the relative angle between the vessel and riser changes. The piping at the top end of the vertical portion of the riser can be designed to accommodate this vertical motion.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a floating offshore structure for producing hydrocarbons where a catenary riser extends from a sea floor to the floating structure, a support for the catenary riser, said support comprising:

a. a riser support receptacle in the keel of the floating offshore structure;

b. a curved riser segment received in said support receptacle and receiving a vertical riser through the offshore structure, said curved riser segment having a radius of curvature of five to ten pipe diameters such that the lower end of said curved riser segment allows connection to a riser below the offshore structure at the natural catenary angle; and c. means attached to said curved riser segment for accommodating relative motion between the catenary riser and offshore structure.

2. The catenary riser support of claim 1, wherein said means for accommodating relative motion between the catenary riser and offshore structure comprises a stress joint.

3. The catenary riser support of claim 1, wherein said means for accommodating relative motion between the catenary riser and offshore structure comprises a flex joint.

4. The catenary riser support of claim 1, further comprising a fitting attached to said curved riser segment, said fitting provided with a complementary shape to that of said riser support receptacle.

5. In a floating offshore structure for producing hydrocarbons where a catenary riser extends from a sea floor to the floating structure, a support for the catenary riser, said support comprising:

a. a riser support receptacle in the keel of the floating offshore structure;

b. a curved riser segment received in said support receptacle and receiving a vertical riser through the offshore structure, said curved riser segment having a radius of curvature of five to ten pipe diameters such that the lower end of said curved riser segment allows connection to a riser below the offshore structure at the natural catenary angle;

c. a fitting attached to said curved riser segment, said fitting provided with a complementary shape to that of said riser support receptacle; and d. means attached to said curved riser segment for accommodating relative motion between the catenary riser and offshore structure, said means comprising a stress joint.

6. The catenary riser support of claim 5, further comprising means for latching said fitting to said riser support receptacle.

7. In a floating offshore structure for producing hydrocarbons where a catenary riser extends from a sea floor to the floating structure, a support for the catenary riser, said support comprising:

a. a riser support receptacle in the keel of the floating offshore structure;

b. a curved riser segment received in said support receptacle and receiving a vertical riser through the offshore structure, said curved riser segment having a radius of curvature of five to ten pipe diameters such that the lower end of said curved riser segment allows connection to a riser below the offshore structure at the natural catenary angle;

c. a fitting attached to said curved riser segment, said fitting provided with a complementary shape to that of said riser support receptacle; and d. means attached to said curved riser segment for accommodating relative motion between the catenary riser and offshore structure, said means comprising a flex joint.

8. The catenary riser support of claim 7, further comprising means for latching said fitting to riser support receptacle.

* * * * *